US010253653B2

(12) United States Patent
Tsukuda et al.

(10) Patent No.: US 10,253,653 B2
(45) Date of Patent: Apr. 9, 2019

(54) EXHAUST CHAMBER COOLING APPARATUS AND STEAM TURBINE POWER GENERATING FACILITY

(71) Applicant: Kabushiki Kaisha Toshiba, Minato-ku (JP)

(72) Inventors: Nozomi Tsukuda, Yokohama (JP); Daisuke Ishikawa, Yokohama (JP); Koki Nishimura, Yokohama (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 438 days.

(21) Appl. No.: 14/965,078

(22) Filed: Dec. 10, 2015

(65) Prior Publication Data

US 2016/0169054 A1 Jun. 16, 2016

(30) Foreign Application Priority Data

Dec. 16, 2014 (JP) ..... 2014-254201
Nov. 12, 2015 (JP) ..... 2015-222286

(51) Int. Cl.
*B01D 19/00* (2006.01)
*F01K 13/00* (2006.01)
(Continued)

(52) U.S. Cl.
CPC ..... *F01K 13/003* (2013.01); *F01D 25/12* (2013.01); *F01K 7/165* (2013.01); *F01K 11/02* (2013.01); *F01K 13/02* (2013.01)

(58) Field of Classification Search
CPC ..... F01K 13/003; F01K 11/02; F01D 25/12
(Continued)

(56) References Cited

U.S. PATENT DOCUMENTS

2005/0160750 A1* 7/2005 Shaffer ..... F04D 27/0246 62/228.1
2007/0271938 A1* 11/2007 Shaffer ..... F25B 27/00 62/228.1
2013/0000304 A1* 1/2013 Tsuboi ..... F01K 9/023 60/665

FOREIGN PATENT DOCUMENTS

JP 52-54806 A 5/1977
JP 53-102403 A 9/1978
(Continued)

OTHER PUBLICATIONS

W. G. Steltz "An Approach to Resolving the Very Low Flow Phenomenon in Low Pressure Steam Turbines", PWR—vol. 34, 1999 Joint Power Generation Conference, vol. 2, ASME 1999, 7 pages.

*Primary Examiner* — Jason Shanske
(74) *Attorney, Agent, or Firm* — Oblon, McClelland, Maier & Neustadt, L.L.P.

(57) ABSTRACT

In one embodiment, an exhaust chamber cooling apparatus measures output of a generator driven by a steam turbine, a temperature in an exhaust chamber of the turbine, and a pressure in a condenser that changes steam from the turbine back to water. The apparatus further outputs a first signal when it is detected that a measurement value of the output is larger than a first setting value and a measurement value of the temperature is larger than a second setting value, and a second signal when it is detected that the measurement value of the output is smaller than the first setting value and a measurement value of the pressure or a calculation value obtained from the measurement value of the pressure is larger than a third setting value. The apparatus further controls supply of a cooling fluid into the chamber, based on the first or second signal.

6 Claims, 7 Drawing Sheets

(51) Int. Cl.

| | |
|---|---|
| ***F01K 11/02*** | (2006.01) |
| ***F01D 25/12*** | (2006.01) |
| ***F01K 7/16*** | (2006.01) |
| ***F01K 13/02*** | (2006.01) |

(58) Field of Classification Search
USPC ..... 60/657
See application file for complete search history.

(56) References Cited

FOREIGN PATENT DOCUMENTS

| | | | |
|---|---|---|---|
| JP | 54-96609 | A | 7/1979 |
| JP | 55-153804 | A | 12/1980 |
| JP | 57-99220 | A | 6/1982 |

* cited by examiner

EXHAUST CHAMBER COOLING APPARATUS AND STEAM TURBINE POWER GENERATING FACILITY

CROSS REFERENCE TO RELATED APPLICATION

This application is based upon and claims the benefit of priority from the prior Japanese Patent Applications No. 2014-254201, filed on Dec. 16, 2014 and No. 2015-222286, filed on Nov. 12, 2015, the entire contents of which are incorporated herein by reference.

FIELD

Embodiments described herein relate to an exhaust chamber cooling apparatus and a steam turbine power generating facility.

BACKGROUND

In recent years, there has been an increasing need for long term operation of a steam turbine in an extremely low load region. An example of the extremely low load operation is on-the-spot load operation for generating only on-the-spot power in a power plant.

In the extremely low load region, a low pressure downstream stage in the steam turbine does not cause any work, but conversely acts as a brake. Therefore, the operation in the extremely low load region results in generating heat in the low pressure downstream stage and increasing temperatures of blades in an exhaust chamber and a final stage of the steam turbine. In order to suppress the increases of these temperatures, a conventional steam turbine power generating facility operates exhaust chamber spray water of the steam turbine in a method as illustrated in FIG. 3.

FIG. 3 is a graph illustrating a conventional operation range of exhaust chamber spray water.

The horizontal axis in FIG. 3 indicates a load of the steam turbine (turbine load). The vertical axis in FIG. 3 indicates a temperature in the exhaust chamber of the steam turbine (exhaust chamber temperature). A region $R_1$ indicates a region of operating the exhaust chamber spray water. A region $R_2$ indicates a region of not operating the exhaust chamber spray water.

Regarding FIG. 3, in the case where the turbine load is larger than $L_1$, the exhaust chamber spray water is operated when the exhaust chamber temperature is higher than $T_1$, and the exhaust chamber spray water is not operated when the exhaust chamber temperature is lower than $T_1$. On the other hand, when the turbine load is smaller than $L_1$, the exhaust chamber spray water is operated at all times regardless of the exhaust chamber temperature. By doing so, in the extremely low load region, the exhaust chamber spray water is operated at all times, so that the increase in temperature of the blades of the exhaust chamber and the final stage of the steam turbine can be suppressed.

FIG. 4 is a schematic diagram illustrating a configuration of a conventional steam turbine power generating facility.

The steam turbine power generating facility in FIG. 4 includes a steam turbine 1, a generator 2, a main steam valve 3, a condenser 4, an actuation valve 5, an exhaust chamber spray 6 and an exhaust chamber cooling apparatus 7.

In FIG. 4, main steam from piping having the main steam valve 3 is introduced into the steam turbine 1, so that a rotor of the steam turbine 1 is rotated with the steam, the rotation of the rotor drives the generator 2, and the generator 2 generates power. The steam discharged from an exhaust chamber R of the steam turbine 1 is condensed by the condenser 4 to be changed back to water. The water is cooled by a cooling system downstream of the condenser 4. A part of the water cooled by the cooling system is given pressure by a pump and fed to the exhaust chamber spray 6 in the exhaust chamber R from piping having the actuation valve 5 to be released in the exhaust chamber R as spray.

The exhaust chamber cooling apparatus 7 in FIG. 4 includes an output measuring module 11, an output lower limit restricting module 12, an output setting value inputting module 13, a logical negation (NOT) module 14, an actuation valve controller 15, a temperature measuring module 21, a temperature upper limit restricting module 22, a temperature setting value inputting module 23 and a logical sum (AND) module 24.

The output measuring module 11 measures output of the generator 2 (generating-end output) and outputs a measurement value W of the generating-end output. The output lower limit restricting module 12 compares the measurement value W of the generating-end output with an output setting value $W_L$ that is set in the output setting value inputting module 13 and outputs a signal $S_1$ containing the comparison result. The signal $S_1$ is low when the measurement value W of the generating-end output is larger than the output setting value $W_L$ ($W>W_L$), and is high when the measurement value W of the generating-end output is smaller than the output setting value $W_L$ ($W<W_L$).

The temperature measuring module 21 measures a temperature in the exhaust chamber R of the steam turbine 1 (exhaust chamber temperature) and outputs a measurement value T of the exhaust chamber temperature. The temperature upper limit restricting module 22 compares the measurement value T of the exhaust chamber temperature with a temperature setting value $T_U$ that is set in the temperature setting value inputting module 23 and outputs a signal $S_2$ containing the comparison result. The signal $S_2$ is low when the measurement value T of the exhaust chamber temperature is smaller than the temperature setting value $T_U$ ($T<T_U$), and is high when the measurement value T of the exhaust chamber temperature is larger than the temperature setting value $T_U$ ($T>T_U$).

The NOT module 14 outputs the NOT value of the signal $S_1$ as a signal $S_3$. Therefore, the signal $S_3$ is low when the measurement value W of the generating-end output is smaller than the output setting value $W_L$ ($W<W_L$), and is high when the measurement value W of the generating-end output is larger than the output setting value $W_L$ ($W>W_L$).

The AND module 24 outputs the AND value of the signal $S_2$ and the signal $S_3$ as a signal $S_4$. Therefore, the signal $S_4$ is high when the measurement value W of the generating-end output is larger than the output setting value $W_L$ and the measurement value T of the exhaust chamber temperature is larger than the temperature setting value $T_U$ ($W>W_L$ and $T>T_U$). Otherwise, the signal $S_4$ is low.

The actuation valve controller 15 controls the actuation valve 5 based on the signal $S_4$ or $S_1$ to control supply of spray water into the exhaust chamber R of the steam turbine 1. The exhaust chamber R is cooled with the spray water. For example, the actuation valve controller 15 is turned ON when the signal $S_4$ or $S_1$ is high, opens the actuation valve 5 at its full state, and thereby, operates the exhaust chamber spray water. Otherwise, the actuation valve controller 15 is turned OFF and fully shuts the actuation valve 5, so that the exhaust chamber spray water is not operated.

Accordingly, the actuation valve controller 15 operates the exhaust chamber spray water when the signal $S_4$ is high, that is, when the measurement value W of the generating-end output is larger than the output setting value $W_L$ and the measurement value T of the exhaust chamber temperature is larger than the temperature setting value $T_U$ ($W>W_L$ and $T>T_U$). This corresponds to the case where the turbine load is larger than $L_1$ in FIG. 3.

Moreover, the actuation valve controller 15 operates the exhaust chamber spray water when the signal $S_1$ is high, that is, when the measurement value W of the generating-end output is smaller than the output setting value $W_L$ ($W<W_L$). This corresponds to the case where the turbine load is smaller than $L_1$ in FIG. 3. As indicated by sign P, the signal $S_1$ is supplied from the output lower limit restricting module 12 to the actuation valve controller 15.

In this way, the operation range of the exhaust chamber spray water illustrated in FIG. 3 can be realized by the steam turbine power generating facility in FIG. 4.

FIG. 5 is a graph illustrating an example of no-load operation that was performed in another conventional steam turbine power generating facility. It should be noted that the same reference numerals as those for the steam turbine power generating facility in FIG. 4 are used in the following description for convenience of explanation.

The horizontal axis in FIG. 5 indicates time. A curve $C_1$ indicates the number of revolutions of the rotor of the steam turbine 1 (rotor rotational speed). A curve $C_2$ indicates a pressure in the condenser 4 (condenser pressure). Sign S denotes an operation state of the exhaust chamber spray water in the exhaust chamber R of the steam turbine 1. A curve $C_3$ indicates a temperature in the exhaust chamber R of the steam turbine 1 (exhaust chamber temperature). A curve $C_4$ indicates a temperature of a nozzle (nozzle tip portion) in the final stage of the steam turbine 1. A curve $C_5$ indicates a temperature of a nozzle diaphragm (nozzle tip portion) in the final stage of the steam turbine 1.

FIG. 6 is a cross-sectional view for explaining measurement positions of the temperatures shown in FIG. 5.

Sign L-0 denotes the nozzle in the final stage of the steam turbine 1. Sign $A_1$ denotes a measurement position of the temperature of the curve $C_4$. Sign $A_2$ denotes a measurement position of the temperature of the curve $C_5$.

Typically, if the steam in the exhaust chamber R is wet steam, latent heat of the moisture in the steam suppresses the exhaust chamber temperature at the saturation temperature. However, in no load, the condition in the exhaust chamber R is a dry condition. Therefore, in no load, the exhaust chamber temperature drastically elevates if the exhaust chamber spray water is not inputted to the exhaust chamber R.

This will be explained with reference to FIG. 5. The state of the steam turbine 1 during the period of time illustrated in FIG. 5 is a no-load operation state, and the exhaust chamber spray 6 is tentatively manually operated to be turned ON/OFF.

The steam turbine 1 is started at 10:30 and the rotor rotational speed $C_1$ is elevating from 10:30. The condenser pressure $C_2$ is approximately 7 inHga at 10:30.

Until the rotor rotational speed $C_1$ becomes stable at 2500 rpm at 13:20, the exhaust chamber temperature $C_3$ has elevated up to 270 degrees Fahrenheit (approximately 130° C.). The operation state S of the exhaust chamber spray water is partially manually switched to be ON at 13:20. By doing so, the exhaust chamber temperature $C_3$ descends down to 160 degrees Fahrenheit (approximately 70° C.).

After that, the rotor rotational speed $C_1$ is increased from 2500 rpm, and simultaneously, the condenser pressure $C_2$ is reduced. The rotor rotational speed $C_1$ has reached the rated rotational speed of 3600 rpm at 14:00. In this stage, the condenser pressure $C_2$ is approximately 6.5 inHga.

The operation state S of the exhaust chamber spray water is switched to be OFF from 14:00 for several minutes. By doing so, the exhaust chamber temperature $C_3$ drastically elevates again up to 270 degrees Fahrenheit (approximately 130° C.).

Upon switching the operation state S of the exhaust chamber spray water to be ON again, the exhaust chamber temperature $C_3$ drastically descends down to 160 degrees Fahrenheit (approximately 70° C.).

After that, with the rotor rotational speed $C_1$ maintained at the rated rotational speed of 3600 rpm, the condenser pressure $C_2$ is gradually reduced. After the condenser pressure $C_2$ has reached the rated pressure of 5.5 inHga, this pressure is maintained as the condenser pressure $C_2$.

In this state, the operation state S of the exhaust chamber spray water is switched to be OFF again from 16:15 for several minutes. By doing so, the exhaust chamber temperature $C_3$ drastically elevates again up to 250 degrees Fahrenheit (approximately 120° C.).

Upon switching the operation state S of the exhaust chamber spray water to be ON again, the exhaust chamber temperature $C_3$ drastically descends down to 150 degrees Fahrenheit (approximately 65° C.).

During an OFF period from 16:15 for several minutes, the temperature $C_4$ of the nozzle in the final stage has reached 430 degrees Fahrenheit (approximately 220° C.) and the temperature $C_4$ of the nozzle diaphragm in the final stage has reached 445 degrees Fahrenheit (approximately 230° C.).

The followings are apparent from the aforementioned explanation.

1) As mentioned above, if the exhaust chamber R is in the wet state, the exhaust chamber temperature can be suppressed at the saturation temperature. However, the exhaust chamber R in no load is in the dry condition. Therefore, the exhaust chamber temperature drastically elevates if the exhaust chamber spray water is not inputted to the exhaust chamber R. This is apparent from the elevation of the exhaust chamber temperature during the OFF period around 14:00 and the elevation of the exhaust chamber temperature during the OFF period around 16:15.

2) When the exhaust chamber spray is operated, the exhaust chamber temperature becomes the saturation temperature at the condenser pressure. Therefore, the lower the condenser pressure is, the lower the exhaust chamber temperature becomes. This is apparent from the exhaust chamber temperature after the OFF period around 14:00 being 70° C. and the exhaust chamber temperature after the OFF period around 16:15 being 65° C.

3) The temperature of the nozzle tip portion in the final stage becomes an exceedingly higher temperature as compared with the exhaust chamber temperature. This is apparent from the curves $C_3$, $C_4$ and $C_5$. This phenomenon arises also in the blade tip portion of the final stage. Hereafter, a mechanism thereof will be described.

FIG. 7 is a cross-sectional view illustrating a backward flow and a drift that arise in low load operation of the conventional steam turbine 1.

FIG. 7 illustrates a blade 1*a* and a nozzle 1*b* in the final stage of the steam turbine 1. Sign $P_1$ denotes a tip portion of the blade 1*a* and sign $P_2$ denotes a root portion of the blade 1*a*. In extremely low load operation of the steam turbine 1, an outlet flow of steam in the final stage contains a backward flow from the outlet side and a drift toward the tip in the radial direction. Sign $H_1$ denotes a height of a backward flow region in the radial direction and sign $H_2$ denotes a height of the blade la in the radial direction.

FIG. 8 is a graph illustrating a relation between the turbine load and the backward flow region in the conventional steam turbine 1.

The horizontal axis in FIG. 8 indicates the turbine load on the steam turbine 1. The vertical axis in FIG. 8 indicates a radial directional position from the root portion $P_2$. FIG. 8 shows that the backward flow region becomes wider as the turbine load decreases more. Therefore, in extremely low load operation of the steam turbine 1, a wide backward flow region arises.

FIG. 9 is a graph illustrating relations between the turbine load and the blade tip temperature and exhaust chamber temperatures in the conventional steam turbine 1. The blade tip temperature is a temperature of the blade tip portion $P_1$.

When the wide backward flow region arises in the final stage of the steam turbine 1, heat generated from the blade 1*a* is collected in the blade tip portion $P_1$ and the blade tip temperature becomes higher than the temperature in another place of the blade 1*a*. Therefore, in extremely low load operation of the steam turbine 1, the blade tip temperature can be higher than the exhaust chamber temperature by 150° C. or more as illustrated in FIG. 9.

In this manner, in extremely low load operation, even when the exhaust chamber temperature is low, the blade tip temperature is high. Moreover, since the blade tip temperature suffers wide variation depending on the measurement position of the temperature, this is not proper for use as a value for control. Therefore, in the conventional extremely low load operation, the exhaust chamber spray water is designed so as to be operated at all times without the operation of the exhaust chamber spray water controlled based on the exhaust chamber temperature and the blade tip temperature.

DETAILED DESCRIPTION

Embodiments will now be explained with reference to the accompanying drawings.

As mentioned above, when the steam turbine 1 is operated in the extremely low load region, the exhaust chamber spray water is operated at all times, and thereby, the increase in exhaust chamber temperature can be securely suppressed. However, when water drops of the exhaust chamber spray water collide with the blade 1*a*, the blade 1*a* suffers erosion. The longer the time when the exhaust chamber spray water is being operated becomes, the more the erosion of the blade 1*a* tends to progress, which causes the lifetime of the blade 1*a* to be shorter.

Figure 10:
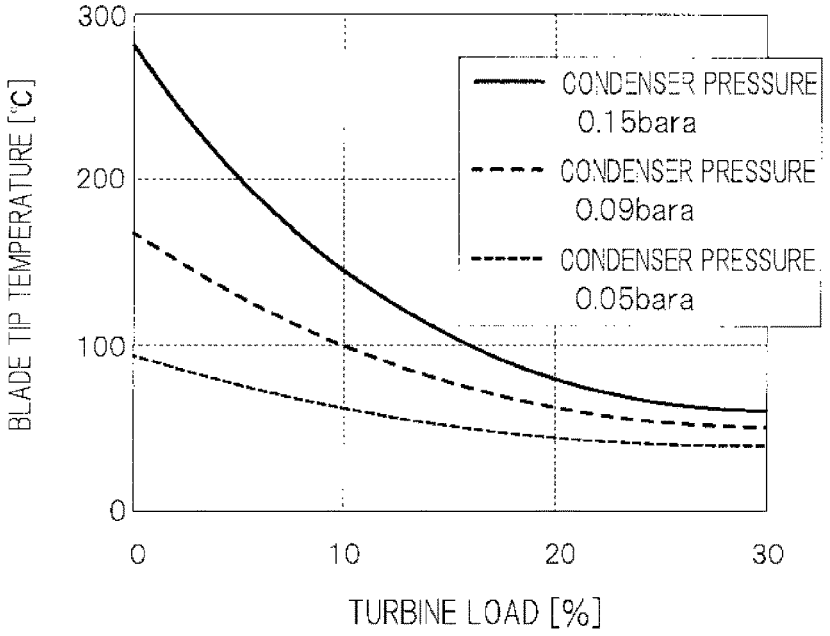
F I G. 10 Prior Art
FIG. 10 is a graph illustrating relations between the turbine load and the blade tip temperature in a typical steam turbine.

FIG. 10 is a graph illustrating relations between the turbine load and the blade tip temperatures in a typical steam turbine 1.

FIG. 10 illustrates the blade tip temperatures in the cases of the condenser pressure being 0.15 bara, 0.09 bara and 0.05 bara. FIG. 10 shows that the higher the condenser pressure is, the higher the blade tip temperature becomes, and that the lower the condenser pressure is, the lower the blade tip temperature is suppressed to be.

Although the blade tip temperature varies depending on the type of the blade 1*a* in the final stage and the temperature of the low pressure turbine inlet, in the example of FIG. 10, the blade tip temperature exceeds 200° C. when the turbine load is less than 4% in the case of the condenser pressure being 0.15 bara. In such a case, use of the exhaust chamber spray water is desirable for preventing decrease in strength of the blade 1*a* and contact between the blade 1*a* and a stationary part due to thermal expansion. Meanwhile, the blade tip temperature is held to be less than 100° C. when the condenser pressure is 0.05 bara. In such a case, the exhaust chamber spray water is not needed to be used.

As described above, for the purpose of the long term operation of the steam turbine 1 in a low load region, operation time of the exhaust chamber spray water is shortened as more as possible or the exhaust chamber spray water is not used as less as possible by limiting operation conditions of the exhaust chamber spray water.

In one embodiment, an exhaust chamber cooling apparatus includes an output measuring module configured to measure output of a generator driven by a steam turbine, a temperature measuring module configured to measure a temperature in an exhaust chamber of the steam turbine, and a pressure measuring module configured to measure a pressure in a condenser that changes steam from the steam turbine back to water. The apparatus further includes a first signal outputting module configured to output a first signal when it is detected that a measurement value of the output is larger than a first setting value and a measurement value of the temperature is larger than a second setting value, and a second signal outputting module configured to output a second signal when it is detected that the measurement value of the output is smaller than the first setting value and a measurement value of the pressure or a calculation value obtained from the measurement value of the pressure is larger than a third setting value. The apparatus further includes a controller configured to control supply of a cooling fluid into the exhaust chamber, based on the first or second signal.

(First Embodiment)

Figure 1:
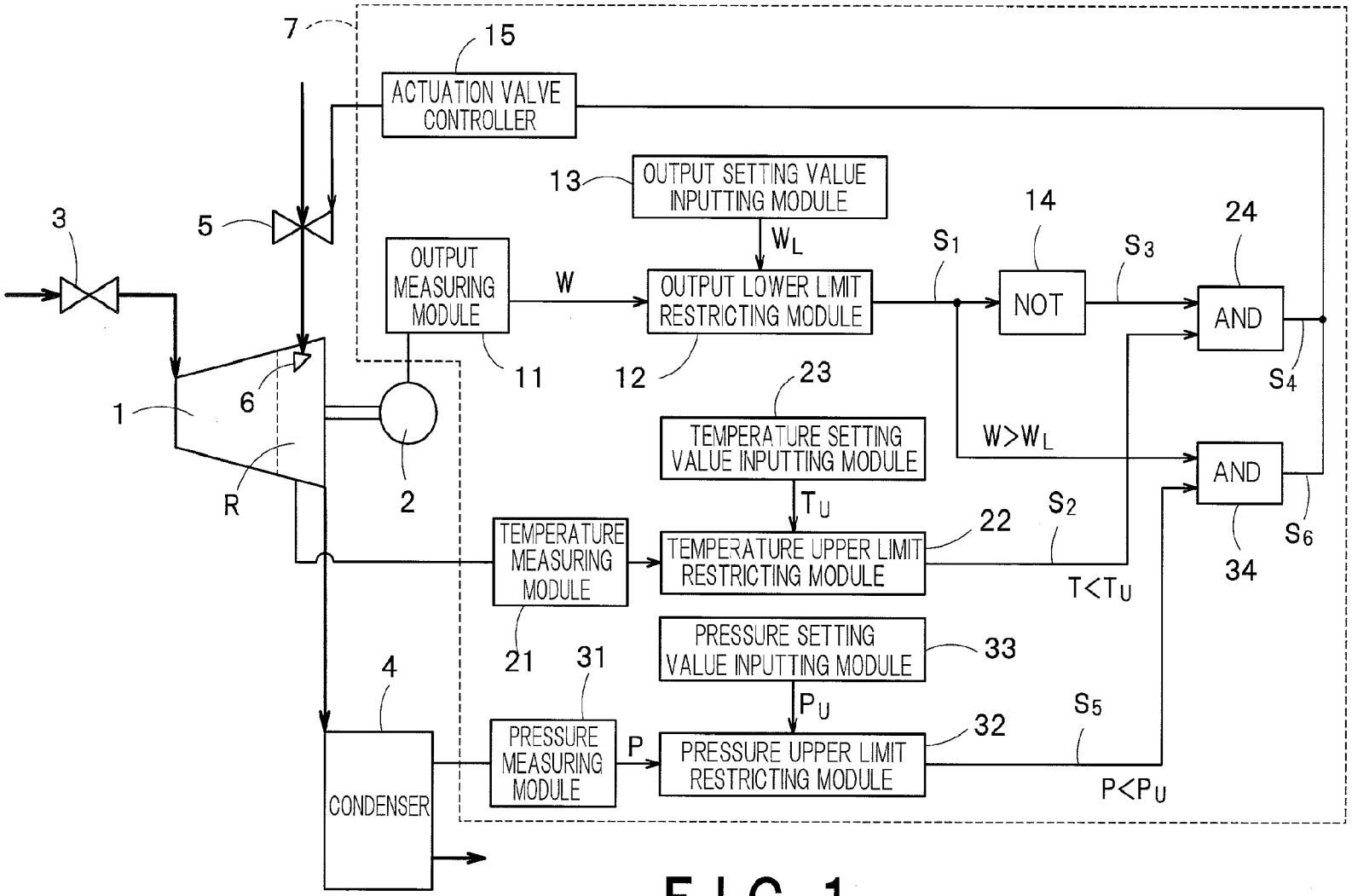
FIG. 1 is a schematic diagram illustrating a configuration of a steam turbine power generating facility of a first embodiment.

FIG. 1 is a schematic diagram illustrating a configuration of a steam turbine power generating facility of a first embodiment. An example of the steam turbine power generating facility in FIG. 1 is a geothermal power generating facility.

The steam turbine power generating facility in FIG. 1 includes the steam turbine 1, the generator 2, the main steam valve 3, the condenser 4, the actuation valve 5, the exhaust chamber spray 6 and the exhaust chamber cooling apparatus 7.

In FIG. 1, main steam from piping having the main steam valve 3 is introduced into the steam turbine 1, so that the rotor of the steam turbine 1 is rotated with the steam, the rotation of the rotor drives the generator 2, and the generator 2 generates power. The steam discharged from the exhaust chamber R of the steam turbine 1 is condensed by the condenser 4 to be changed back to water. The water is cooled by a cooling system downstream of the condenser 4. A part of the water cooled by the cooling system is given pressure by a pump and fed to the exhaust chamber spray 6 in the exhaust chamber R from piping having the actuation valve 5 to be released in the exhaust chamber R as spray.

The actuation valve 5 of the present embodiment may be any type of valve. An example of the actuation valve 5 of the present embodiment is a flow rate regulating valve or an on/off valve.

The exhaust chamber cooling apparatus 7 in FIG. 1 includes the output measuring module 11, the output lower limit restricting module 12, the output setting value inputting module 13, the logical negation (NOT) module 14, the actuation valve controller 15, the temperature measuring module 21, the temperature upper limit restricting module 22, the temperature setting value inputting module 23, the logical sum (AND) module 24, a pressure measuring module 31, a pressure upper limit restricting module 32, a pressure setting value inputting module 33 and a logical sum (AND) module 34.

The output lower limit restricting module 12, the output setting value inputting module 13, the NOT module 14, the temperature upper limit restricting module 22, the temperature setting value inputting module 23 and the AND module 24 are an example of a first signal outputting module. Moreover, the output lower limit restricting module 12, the output setting value inputting module 13, the pressure upper limit restricting module 32, the pressure setting value inputting module 33 and the AND module 34 are an example of a second signal outputting module. Moreover, the actuation valve controller 15 is an example of a controller.

The output measuring module 11 measures output of the generator 2 (generating-end output) and outputs the measurement value W of the generating-end output. The output lower limit restricting module 12 compares the measurement value W of the generating-end output with the output setting value $W_L$ that is set in the output setting value inputting module 13 and outputs the signal $S_1$ containing the comparison result. The output setting value $W_L$ is an example of a first setting value. The signal $S_1$ is low when the measurement value W of the generating-end output is larger than the output setting value $W_L$ ($W>W_L$), and is high when the measurement value W of the generating-end output is smaller than the output setting value $W_L$ ($W<W_L$).

When the measurement value W of the generating-end output is equal to the output setting value $W_L$, the value of the signal $S_1$ of the present embodiment is high ($W=W_L$). It should be noted that the value of the signal $S_1$ may be low in this case.

The temperature measuring module 21 measures a temperature in the exhaust chamber R of the steam turbine 1 (exhaust chamber temperature) and outputs the measurement value T of the exhaust chamber temperature. The temperature upper limit restricting module 22 compares the measurement value T of the exhaust chamber temperature with the temperature setting value $T_U$ that is set in the temperature setting value inputting module 23 and outputs the signal $S_2$ containing the comparison result. The temperature setting value $T_U$ is an example of a second setting value. The signal $S_2$ is low when the measurement value T of the exhaust chamber temperature is smaller than the temperature setting value $T_U$ ($T<T_U$), and is high when the measurement value T of the exhaust chamber temperature is larger than the temperature setting value $T_U$ ($T>T_U$).

When the measurement value T of the exhaust chamber temperature is equal to the temperature setting value $T_U$, the value of the signal $S_2$ of the present embodiment is high ($T=T_U$). It should be noted that the value of the signal $S_2$ may be low in this case.

The pressure measuring module 31 measures a pressure in the condenser 4 (condenser pressure) and outputs a measurement value P of the condenser pressure. The pressure upper limit restricting module 32 compares the measurement value P of the condenser pressure with a pressure setting value $P_U$ that is set in the pressure setting value inputting module 33 and outputs a signal $S_5$ containing the comparison result. The pressure setting value $P_U$ is an example of a third setting value. The signal $S_5$ is low when the measurement value P of the condenser pressure is smaller than the pressure setting value $P_U$ ($P<P_U$), and is high when the measurement value P of the condenser pressure is larger than the pressure setting value $P_U$ ($P>P_U$).

When the measurement value P of the condenser pressure is equal to the pressure setting value $P_U$, the value of the signal $S_5$ of the present embodiment is high ($P=P_U$). It should be noted that the value of the signal $S_5$ may be low in this case.

The NOT module 14 outputs the NOT value of the signal $S_1$ as the signal $S_3$. Therefore, the signal $S_3$ is low when the measurement value W of the generating-end output is smaller than the output setting value $W_L$ ($W<W_L$), and is high when the measurement value W of the generating-end output is larger than the output setting value $W_L$ ($W>W_L$).

The AND module 24 outputs the AND value of the signal $S_2$ and the signal $S_3$ as the signal $S_4$. Therefore, the signal $S_4$ is high when the measurement value W of the generating-end output is larger than the output setting value $W_L$ and the measurement value T of the exhaust chamber temperature is larger than the temperature setting value $T_U$ ($W>W_L$ and $T>T_U$). Otherwise, the signal $S_4$ is low. In this way, the AND module 24 outputs the signal $S_4$ having the value of high when it is detected that the measurement value W of the generating-end output is larger than the output setting value $W_L$ and the measurement value T of the exhaust chamber temperature is larger than the temperature setting value $T_U$. The signal $S_4$ having the value of high is an example of a first signal.

The AND module 34 outputs the AND value of the signal $S_1$ and the signal $S_5$ as a signal $S_6$. Therefore, the signal $S_6$ is high when the measurement value W of the generating-end output is smaller than the output setting value $W_L$ and the measurement value P of the condenser pressure is larger than the pressure setting value $P_U$ ($W<W_L$ and $P>P_U$). Otherwise, the signal $S_6$ is low. In this way, the AND module 34 outputs the signal $S_6$ having the value of high when it is detected that the measurement value W of the generating-end output is smaller than the output setting value $W_L$ and the measurement value P of the condenser pressure is larger than the pressure setting value $P_U$. The signal $S_6$ having the value of high is an example of a second signal.

The actuation valve controller 15 controls the actuation valve 5 based on the signal $S_4$ or $S_6$ to control supply of spray water into the exhaust chamber R of the steam turbine 1. The exhaust chamber R is cooled with the spray water.

The spray water is an example of a cooling fluid. For example, the actuation valve controller 15 is turned ON when the signal $S_4$ or $S_6$ is high, opens the actuation valve 5 at its full state, and thereby, operates the exhaust chamber spray water. Otherwise, the actuation valve controller 15 is turned OFF and fully shuts the actuation valve 5, so that the exhaust chamber spray water is not operated.

Accordingly, the actuation valve controller 15 operates the exhaust chamber spray water when the signal $S_4$ is high, that is, when the measurement value W of the generating-end output is larger than the output setting value $W_L$ and the measurement value T of the exhaust chamber temperature is larger than the temperature setting value $T_U$ ($W>W_L$ and $T>T_U$). This corresponds to the case where the steam turbine 1 is operated at high load and the exhaust chamber temperature is high.

Moreover, the actuation valve controller 15 operates the exhaust chamber spray water when the signal $S_6$ is high, that is, when the measurement value W of the generating-end output is smaller than the output setting value $W_L$ and the measurement value P of the condenser pressure is larger than the pressure setting value $P_U$ ($W<W_L$ and $P>P_U$). This corresponds to the case where the steam turbine 1 is operated at low load and the condenser pressure is high.

Figure 3:
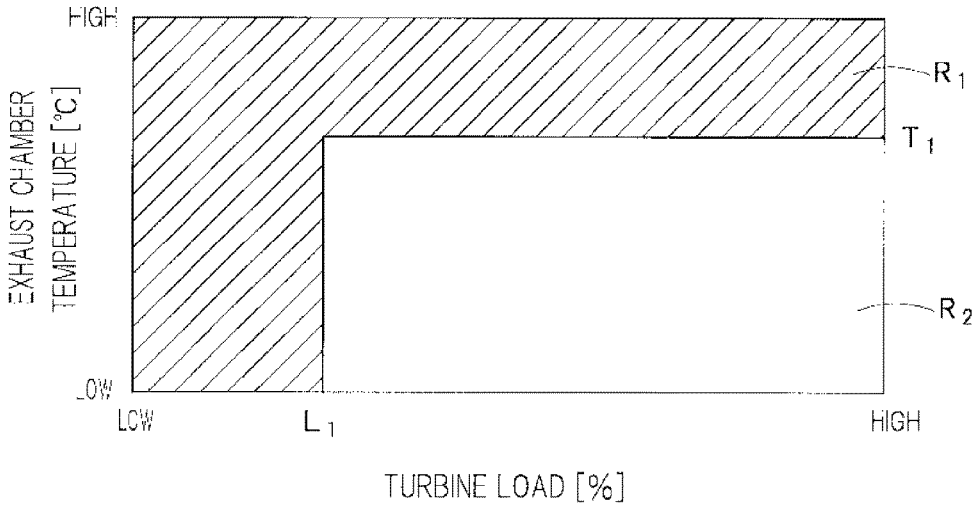
F I G. 3 Prior Art
FIG. 3 is a graph illustrating a conventional operation range of exhaust chamber spray water.
Figure 4:
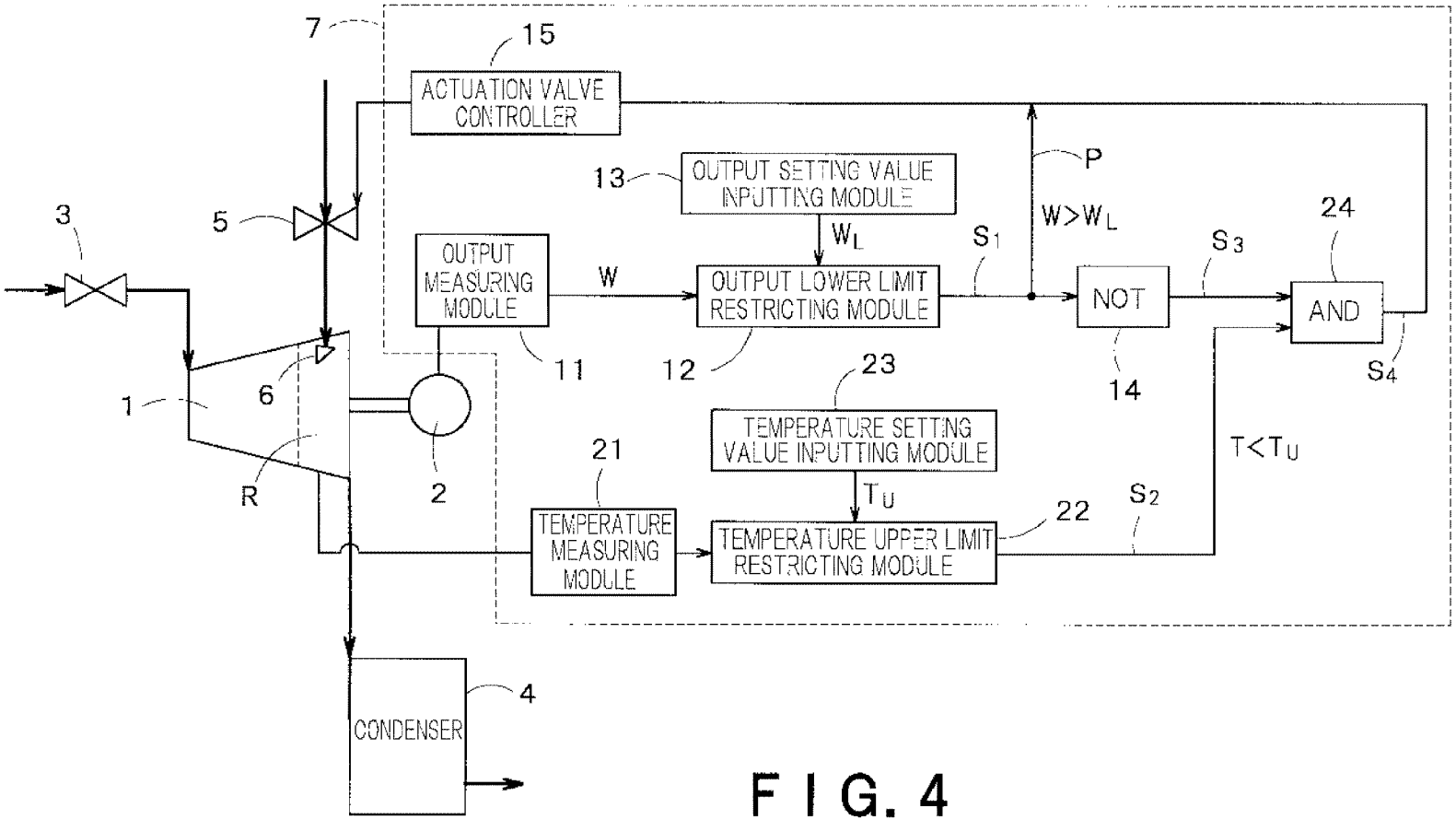
FIG. 4 Prior Art
FIG. 4 is a schematic diagram illustrating a configuration of a conventional steam turbine power generating facility.

Herein, the operation range of the exhaust chamber spray water of the present embodiment is described. See FIG. 3 for the signs $L_1$ and $T_1$.

In the case where the turbine load is larger than $L_1$, the exhaust chamber spray water is operated when the exhaust chamber temperature is higher than $T_1$, and the exhaust chamber spray water is not operated when the exhaust chamber temperature is lower than $T_1$. This operation can be realized by outputting the signal $S_4$ to the actuation valve controller 15.

In the case where the turbine load is smaller than $L_1$, the exhaust chamber spray water is operated when the condenser pressure is higher than $P_1$ (not shown), and the exhaust chamber spray water is not operated when the condenser pressure is lower than $P_1$. This operation can be realized by outputting the signal $S_6$ to the actuation valve controller 15.

The temperature $T_1$ corresponds to the temperature setting value $T_U$. The temperature $T_1$ is, for example, less than 80° C. An example of the temperature $T_1$ is 66° C. The pressure $P_1$ corresponds to the pressure setting value $P_U$. The pressure $P_1$ is, for example, less than 0.05 bara. An example of the pressure $P_1$ is 0.04 bara. The turbine load $L_1$ corresponds to the value having the output setting value $W_L$ converted into the turbine load. The turbine load $L_1$ is, for example, less than 30%. An example of the turbine load $L_1$ is approximately 10% or approximately 20%.

When the steam turbine 1 is operated in a low load region, there can be a case where the exhaust chamber spray water is operated at all times. In this case, although increase in exhaust chamber temperature can be securely suppressed, erosion of the blade 1*a* of the steam turbine 1 causes the lifetime of the blade 1*a* to be shortened. Therefore, it is desirable that operation time of the exhaust chamber spray water is shortened as more as possible by limiting the operation conditions of the exhaust chamber spray water.

Meanwhile, it is not proper for the blade tip temperature to be used for a value for control as described in explaining FIG. 10. As illustrated in FIG. 10, in low load operation, the blade tip temperature becomes exceedingly higher as compared with the exhaust chamber temperature. Therefore, it is desirable that the operation conditions of the exhaust chamber spray water are set such that the blade tip temperature does not exceed, for example, 100° C.

Therefore, in the present embodiment, in the case where the turbine load is smaller than $L_1$ and larger than zero, the exhaust chamber spray water is operated when the condenser pressure is higher than $P_1$, and the exhaust chamber spray water is not operated when the condenser pressure is lower than $P_1$.

Accordingly, the present embodiment makes it possible to operate the spray water when the exhaust chamber spray water is desirable to be used (when the condenser pressure is high), and possible to avoid operating the spray water when the exhaust chamber spray water does not have to be used (when the condenser pressure is low).

Furthermore, according to the present embodiment, while the temperature of the tip portion of the blade 1*a* is suppressed to be low by operating the spray water, the lifetime of the blade la can be prolonged by shortening the operation time of the spray water.

As described above, the steam turbine power generating facility of the present embodiment controls the supply of the spray water into the exhaust chamber R of the steam turbine 1, based on the measurement values of the turbine load, the exhaust chamber temperature and the condenser pressure. Therefore, according to the present embodiment, operation time of the spray water in low load operation can be shortened.

(Second Embodiment)

Figure 2:
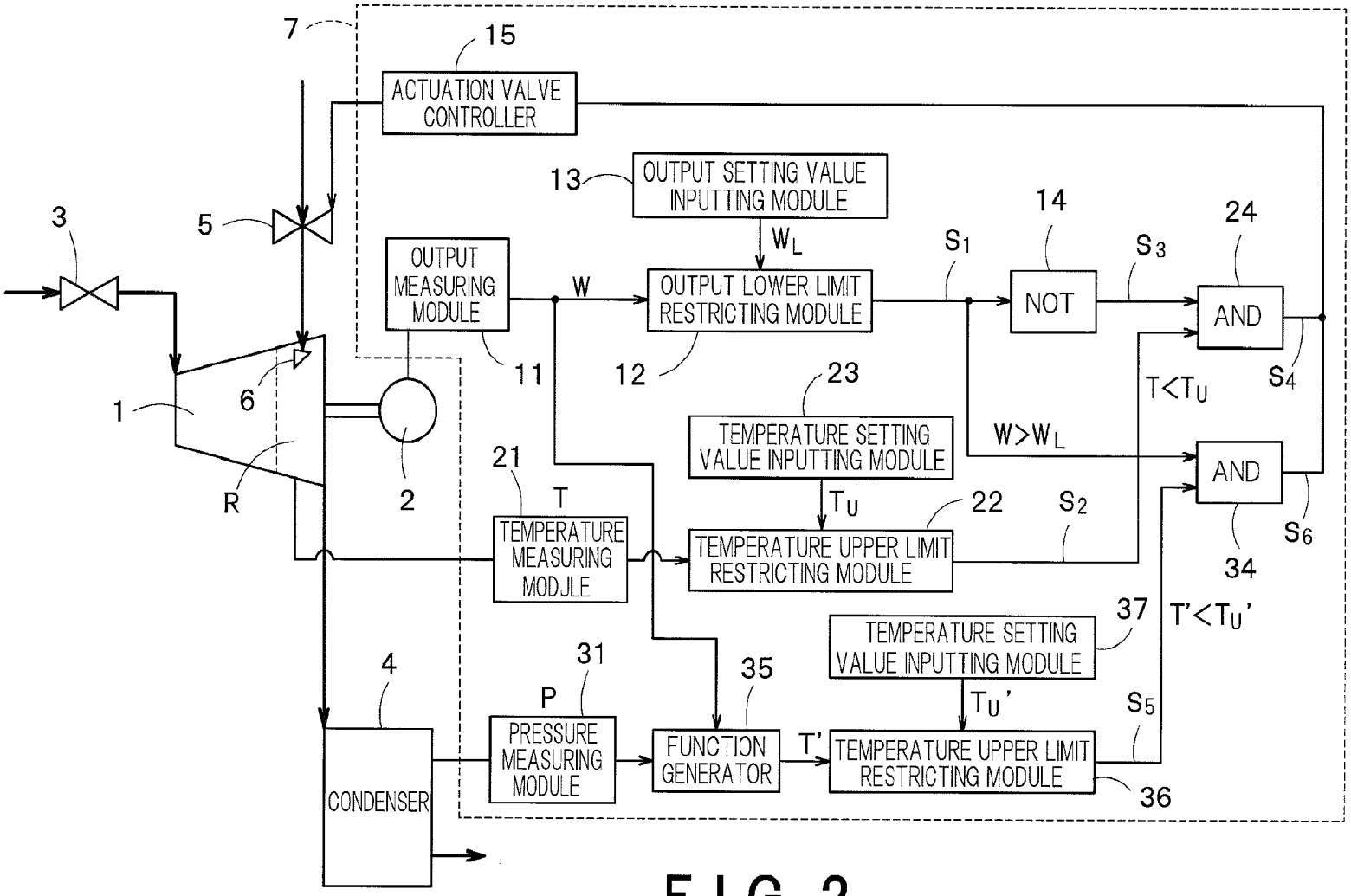
FIG. 2 is a schematic diagram illustrating a configuration of a steam turbine power generating facility of a second embodiment.

FIG. 2 is a schematic diagram illustrating a configuration of a steam turbine power generating facility of a second embodiment. Regarding components illustrated in FIG. 2, the components that are the same as or similar to those in FIG. 1 are given the same signs, and duplicate description of those in the first embodiment is omitted.

The exhaust chamber cooling apparatus 7 of the present embodiment includes a function generating module 35, a temperature upper limit restricting module 36 and a temperature setting value inputting module 37 in place of the pressure upper limit restricting module 32 and the pressure setting value inputting module 33. The output lower limit restricting module 12, the output setting value inputting module 13, the AND module 34, the function generating module 35, the temperature upper limit restricting module 36 and the temperature setting value inputting module 37 are an example of a second signal outputting module.

Figure 5:
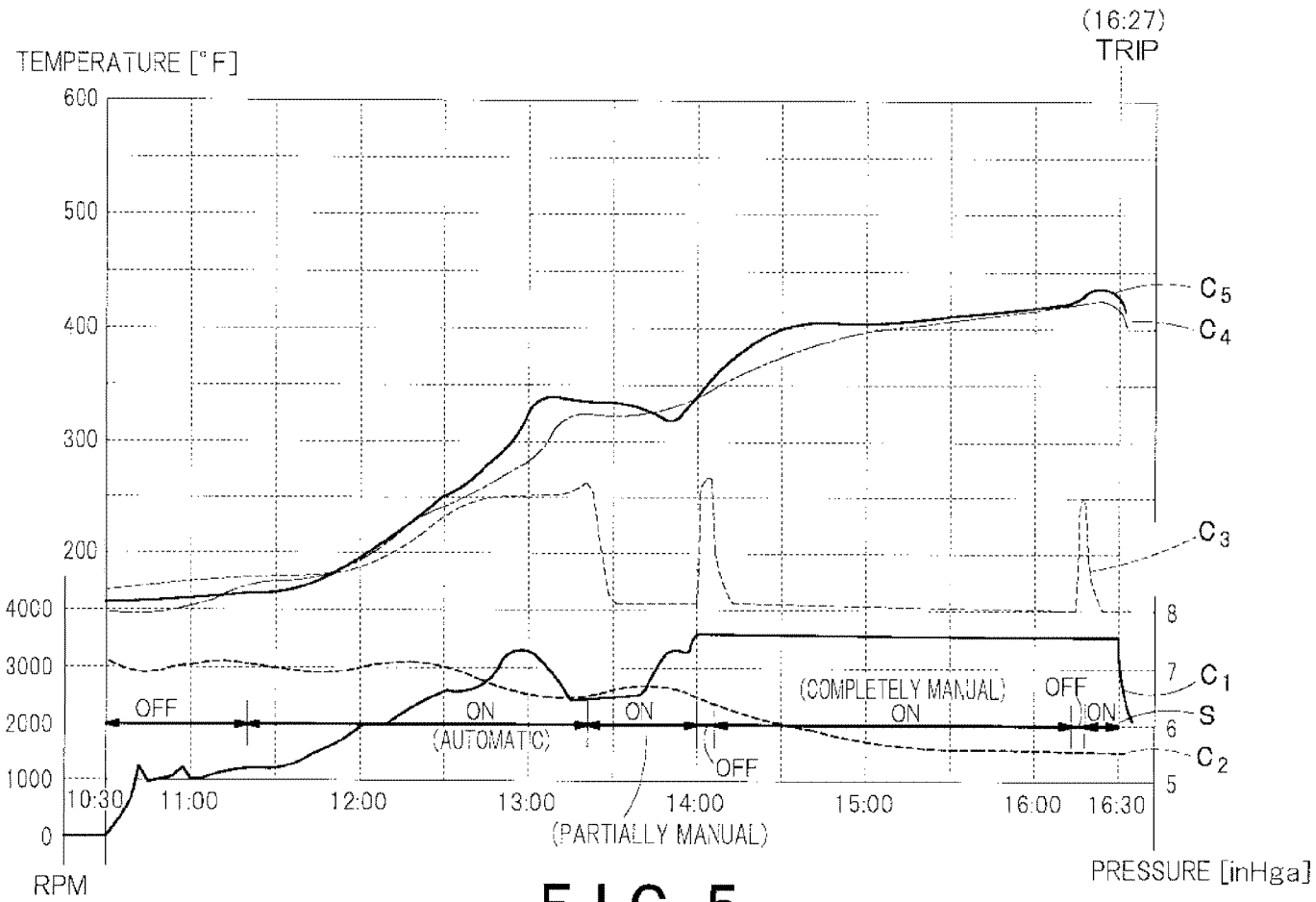
FIG. 5 Prior Art
FIG. 5 is a graph illustrating an example of no-load operation that was performed in another conventional steam turbine power generating facility.
Figure 6:
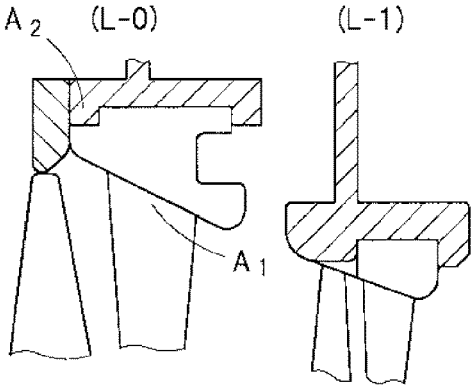
F I G. 6 Prior Art
FIG. 6 is a cross-sectional view for explaining measurement positions of temperatures shown in FIG. 5.
Figure 7:
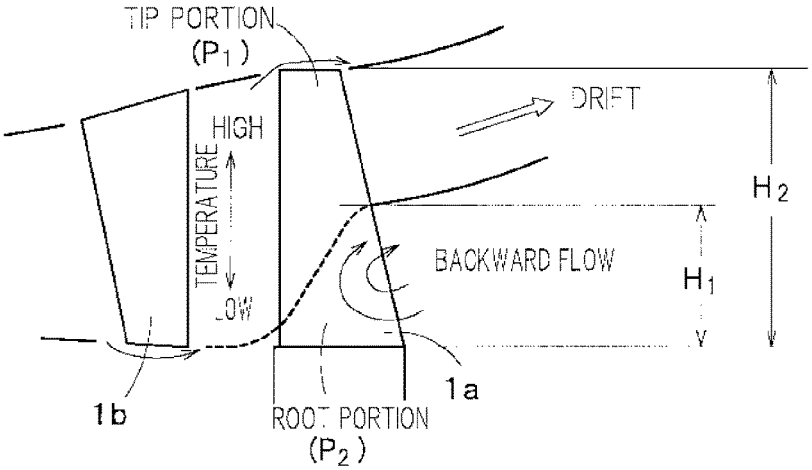
F I G. 7 Prior Art
FIG. 7 is a cross-sectional view illustrating a backward flow and a drift that arise in low load operation of the conventional steam turbine.
Figure 8:
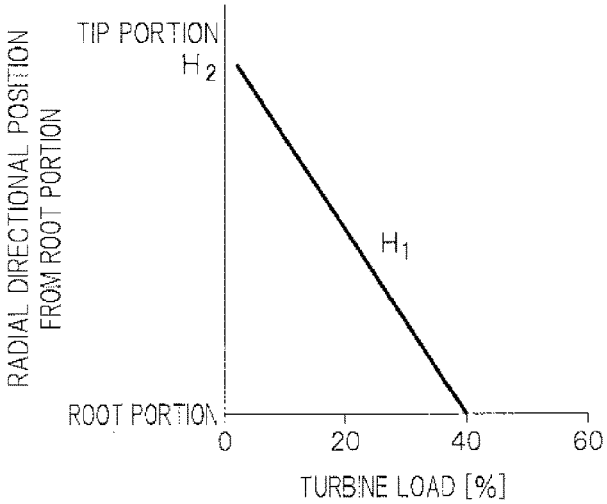
F I G. 8 Prior Art
FIG. 8 is a graph illustrating a relation between a turbine load and a backward flow region in the conventional steam turbine.
Figure 9:
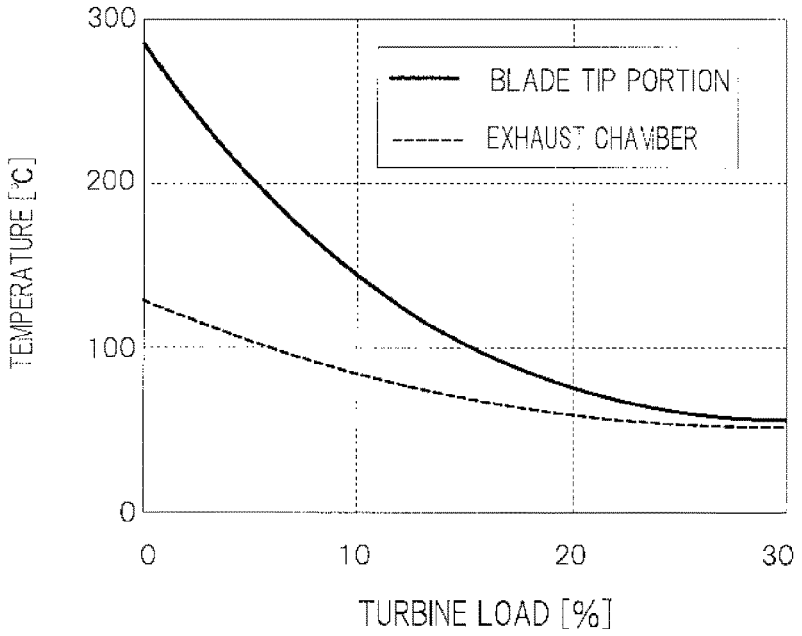
F I G. 9 Prior Art
FIG. 9 is a graph illustrating relations between the turbine load and the blade tip and exhaust chamber temperatures in the conventional steam turbine.

The function generating module 35 receives the measurement value P of the condenser pressure from the pressure measuring module 31 and receives the measurement value W of the generating-end output from the output measuring module 11. The function generating module 35 retains a function for calculating a prediction value T' of the temperature at the tip portion of the blade 1*a* in the final stage of the steam turbine 1. This blade tip temperature is an example of a temperature at a place in the steam turbine 1. The blade tip temperature has a property similar to those of the temperatures $C_4$ and $C_5$ of the nozzle tip portions illustrated in FIG. 5.

The function in the function generating module 35 contains the condenser pressure and the generating-end output as variables. Therefore, the function generating module 35 substitutes the measurement value P of the condenser pressure and the measurement value W of the generating-end output for the function to calculate the prediction value T' of the blade tip temperature. The prediction value T' is an example of a calculation value obtained from the measurement value P of the condenser pressure. An example of the function in the function generating module 35 is a temperature-load curve in FIG. 10.

The temperature upper limit restricting module 36 compares the prediction value T' of the blade tip temperature with a temperature setting value $T_U'$ that is set in the temperature setting value inputting module 37 and outputs the signal $S_5$ containing the comparison result. The temperature setting value $T_U'$ is an example of a third setting value. The signal $S_5$ is low when the prediction value T' of the blade tip temperature is smaller than the temperature setting value $T_U'$ ($T'<T_U'$), and is high when the prediction value T' of the blade tip temperature is larger than the temperature setting value $T_U'$ ($T'<T_U'$).

When the prediction value T' of the blade tip temperature is equal to the temperature setting value $T_U'$, the value of the signal $S_5$ of the present embodiment is high ($T'=T_U'$). It should be noted that the value of the signal $S_5$ may be low in this case.

The AND module 34 outputs the AND value of the signal $S_1$ and the signal $S_5$ as the signal $S_6$. Therefore, the signal $S_6$ is high when the generating-end output W is smaller than the output setting value $W_L$ and the prediction value T of the blade tip temperature is larger than the temperature setting value $T_U'$ ($W<W_L$ and $T'>T_U'$). Otherwise, the signal $S_6$ is low. In this way, the AND module 34 outputs the signal $S_6$ having the value of high when it is detected that the measurement value W of the generating-end output is smaller than the output setting value $W_L$ and the prediction value T' of the blade tip temperature is larger than the temperature setting value $T_U'$. The signal $S_6$ having the value of high is an example of the second signal.

Similarly to the first embodiment, the actuation valve controller 15 controls the actuation valve 5 based on the signal $S_4$ or $S_6$ to control supply of spray water into the exhaust chamber R of the steam turbine 1. Therefore, the actuation valve controller 15 operates the exhaust chamber spray water when the signal $S_6$ is high, that is, when the measurement value W of the generating-end output is smaller than the output setting value $W_L$ and the prediction value T' of the blade tip temperature is larger than the temperature setting value $T_U'$ ($W<W_L$ and $T'>T_U'$).

Similarly to the power generating facility of the first embodiment, the steam turbine power generating facility of the present embodiment can realize the operation range of the exhaust chamber spray water illustrated in FIG. 2.

As described above, the steam turbine power generating facility of the present embodiment controls the supply of the spray water into the exhaust chamber R of the steam turbine 1, based on the measurement values of the turbine load, the exhaust chamber temperature and the condenser pressure. Therefore, according to the present embodiment, operation time of the spray water in low load operation can be shortened.

Moreover, when the steam turbine 1 is operated in a low load region, increase in blade tip temperature is typically problematic. On the other hand, the steam turbine power generating facility of the present embodiment controls the supply of the spray water into the exhaust chamber R of the steam turbine 1, based on the prediction value of the blade tip temperature. Therefore, according to the present embodiment, while increase in blade tip temperature is effectively suppressed, operation time of the spray water in low load operation can be shortened.

While certain embodiments have been described, these embodiments have been presented by way of example only, and are not intended to limit the scope of the inventions. Indeed, the novel apparatuses and facilities described herein may be embodied in a variety of other forms; furthermore, various omissions, substitutions and changes in the form of the apparatuses and facilities described herein may be made without departing from the spirit of the inventions. The accompanying claims and their equivalents are intended to cover such forms or modifications as would fall within the scope and spirit of the inventions.

The invention claimed is:

1. An exhaust chamber cooling apparatus comprising:

a power sensor configured to measure power output of a generator driven by a steam turbine;

a temperature sensor configured to measure a temperature in an exhaust chamber of the steam turbine;

a pressure sensor configured to measure a pressure in a condenser that changes steam from the steam turbine back to water;

a first signal generator circuitry configured to output a first signal when it is detected that a measurement value of the power output is larger than a first setting value and a measurement value of the temperature is larger than a second setting value;

a second signal generator circuitry configured to output a second signal when it is detected that the measurement value of the power output is smaller than the first setting value and a measurement value of the pressure or a calculation value obtained from the measurement value of the pressure is larger than a third setting value; and a hardware controller configured to control a valve for supplying a cooling fluid into the exhaust chamber based on the first or second signal.

2. The apparatus of claim 1, wherein the first setting value is smaller than the measurement value of the power output in a case where a load on the steam turbine is 30%.

3. The apparatus of claim 1, wherein the calculation value is calculated using the measurement value of the pressure and the measurement value of the power output.

4. The apparatus of claim 1, wherein the calculation value is a prediction value of a temperature at a place in the steam turbine.

5. The apparatus of claim 4, wherein the place is a tip portion of a blade in the steam turbine.

6. A steam turbine power generating facility comprising:

a steam turbine;

a generator configured to be driven by the steam turbine;

a condenser configured to change steam from the steam turbine back to water;

a power sensor configured to measure power output of the generator;

a temperature sensor configured to measure a temperature in an exhaust chamber of the steam turbine;

a pressure sensor configured to measure a pressure in the condenser;

a first signal generator circuitry configured to output a first signal when it is detected that a measurement value of the power output is larger than a first setting value and a measurement value of the temperature is larger than a second setting value;

a second signal generator circuitry configured to output a second signal when it is detected that the measurement value of the power output is smaller than the first setting value and a measurement value of the pressure or a calculation value obtained from the measurement value of the pressure is larger than a third setting value; and a hardware controller configured to control a valve for supplying a cooling fluid into the exhaust chamber based on the first or second signal.

* * * * *